US006354380B1

(12) United States Patent
Becnel et al.

(10) Patent No.: US 6,354,380 B1
(45) Date of Patent: Mar. 12, 2002

(54) APPARATUS FOR GUIDING WIRELINE

(76) Inventors: Mark Leo Becnel; Jason Michael Becnel, both of 107-B R St., Belle Chasse, LA (US) 70037

( * ) Notice: Subject to any disclaimer, the term of this patent is extended or adjusted under 35 U.S.C. 154(b) by 0 days.

(21) Appl. No.: 09/551,388

(22) Filed: Apr. 18, 2000

(51) Int. Cl.[7] ..... E21B 33/068
(52) U.S. Cl. ..... 166/385; 166/85.5
(58) Field of Search ..... 166/84.1, 85.5, 166/385, 242.5, 117.5, 87.1, 84.5

(56) References Cited

U.S. PATENT DOCUMENTS

| | | | | |
|---|---|---|---|---|
| 4,307,783 A | * | 12/1981 | Lanmon, II | 166/385 X |
| 4,899,816 A | * | 2/1990 | Mine | 166/85 |
| 5,284,210 A | * | 2/1994 | Helms et al. | 166/385 |
| 5,477,921 A | * | 12/1995 | Tollefsen | 166/250.13 |
| 5,803,191 A | * | 9/1998 | Mackintosh | 166/242.5 X |
| 6,202,764 B1 | * | 3/2001 | Ables et al. | 166/242.5 X |

* cited by examiner

*Primary Examiner*—Frank S. Tsay
(74) *Attorney, Agent, or Firm*—Adams and Reese, LLP

(57) ABSTRACT

An apparatus for guiding wireline into a well bore comprising an insert bowl, the insert bowl having a substantially vertical groove formed in an interior surface thereof. A rotation means is preferably provided on the insert bowl, the rotation means configured and positioned to rotate against a wireline and maintain the wireline substantially in the groove when the insert bowl is positioned in a rotary table of a drilling platform, to thereby prevent damage to the wireline during wireline and drilling operations. The rotation means preferably comprises a support member and a wheel rotatably disposed in the support member, the support member being attached to a top of the insert bowl above the groove. The wheel is preferably configured as a sheave having a concave rim. The support member further preferably comprises a first block member positioned substantially along one side of the groove, a second block member positioned substantially along an opposite side of the groove, and an axle shaft passing between the first and second block members, the wheel being rotatably disposed on the axle shaft. In a preferred embodiment, the rotation means may be readily dismantled after use for inspection and maintenance.

15 Claims, 2 Drawing Sheets

APPARATUS FOR GUIDING WIRELINE

FIELD OF THE INVENTION

The present invention relates to oil field drilling operations and the like, and more particularly to an apparatus for guiding and running wireline through a drilling platform and into a well bore.

BACKGROUND OF THE INVENTION

Well bores of oil wells and the like are typically drilled and operated from a drilling platform, such as an offshore drilling rig. FIG. 1 shows an upper surface of a drilling platform 130. A rotary table 120 is positioned on the surface of the drilling platform 130. The rotary table 120 has a centrally disposed opening. A removable insert bowl 10 is inserted in the opening of the rotary table 120. The insert bowl 10 consists of two substantially identical half pieces 10A and 10B. Insert bowls 10 are manufactured to standard specifications and distributed by numerous companies, including Varco B. J., Dencon, Access Oil Tools, and Texas International Oil Tools. The insert bowl 10 functions as a bushing to protect components that pass through the rotary table 120 during drilling and production operations. One such component is the drill string 110, which passes through the rotary table 120 and into a well bore (not shown) located under the drilling platform 130. The insert bowl 10 also holds slips (not shown), which hold the pipe of the drill string 110.

In drilling operations, logging tools and the like arc often run into the well bore for various purposes, such as to evaluate the progress of the well bore and to identify characteristics of the subterranean strata surrounding the well bore. Logging tools arc run into the well either on the end of the drill string 110, or without the drill string being present. Logging tools and the like are operated via the wireline 100 shown in FIG. 1. The wireline 100 conducts electric signals between the logging tool and the surface of the well, and also serves as a cable for supporting the logging tool and retrieving the tool from the well bore.

In the apparatus and methods of the prior art, the insert bowl 10 is not equipped with the groove 20 and rotation means 50 shown in FIG. 1, but instead consists of two half pieces 10B. In the prior art wireline methods, the wireline 100 typically rides directly along the interior surface of the insert bowl 10B. The interior surface 12 of the insert bowl 10B acts as a bushing to protect the wireline 100. However, tension in the wireline 100 is typically in the order of 300–400 pounds, and rubbing of the wireline 100 against the insert bowl 10B under such tensions is sufficient to damage both the wireline and the interior surface 12 of the bowl 10B. Tension in the wireline can reach 1000–2000 pounds under certain conditions, such as on floating oil rigs during rough seas. Additionally, rotating and/or sliding the drill string 110 during drilling operations may damage or cut the wireline 110. Replacement of broken wireline and damaged insert bowls 10 is expensive. Additionally, retrieving logging tools and broken wireline from the well bore consumes time and labor that could otherwise be devoted to setting drill string. Further, a snapped wireline 100 can cause serious injury to workers on the drilling platform 130.

The present invention provides an apparatus and methods for overcoming the foregoing problems and shortcomings of the prior art.

OBJECTS AND SUMMARY OF THE INVENTION

It is an object of the invention to provide an improved apparatus and methods for guiding and running a wireline into a well bore during wireline and drilling operations.

It is another object of the invention to provide an apparatus and methods for preventing damage to wireline when setting drill pipe slips.

It is another object of the invention to provide an apparatus and methods for avoiding damage to insert bowls.

It is another object of the invention to improve the efficiency of wireline and drilling operations by preventing broken wirelines, thereby reducing downtime caused by retrieval of broken cable and downhole tools.

It is yet another object of the invention to provide safer drilling conditions by preventing broken wirelines.

These and other objects and advantages of the invention shall become apparent from the following general and preferred description of the invention.

Accordingly, an apparatus for guiding wireline into a well bore is provided comprising an insert bowl, the insert bowl having a substantially vertical groove formed in an interior surface thereof. The groove preferably extends substantially from an upper end to a lower end of the insert bowl. A rotation means is preferably provided on the insert bowl, the rotation means configured and positioned to rotate against a wireline and maintain the wireline substantially in the groove when the insert bowl is positioned in a rotary table of a drilling platform, to thereby prevent damage to the wireline during wireline and drilling operations. The rotation means preferably comprises a support member and a wheel rotatably disposed in the support member, the support member being attached to a top of the insert bowl above the groove. The wheel is preferably configured as a sheave having a concave rim. The support member further preferably comprises a first block member positioned substantially along one side of the groove, a second block member positioned substantially along an opposite side of the groove, and an axle shaft passing between the first and second block members, the wheel being rotatably disposed on the axle shaft. A race is preferably disposed between the axle shaft and the wheel.

In a preferred embodiment, the rotation means may be readily dismantled after use for inspection and maintenance. In one such embodiment, the first block member has a hole therethrough and the second block member has a bore on an inner side thereof. The axle shaft passes through the hole of the first block member, and a first end of the axle shaft is disposed in the bore of the second block member. A keeper means is removably disposed on an outer side of the first block member for retaining the axle shaft in the bore and the hole during wireline and drilling operations. The keeper means preferably comprises a keeper block and at least a pair of bolts removably securing the keeper block to the outer side of the first block member. The apparatus is further preferably provided with a grease zert passing through an outer side of the second block member and communicating with the bore to thereby permit application of grease to the apparatus during wireline and drilling operations.

Methods of constructing and using the aforementioned apparatus are also described.

PREFERRED EMBODIMENTS OF THE INVENTION

Figure 1:
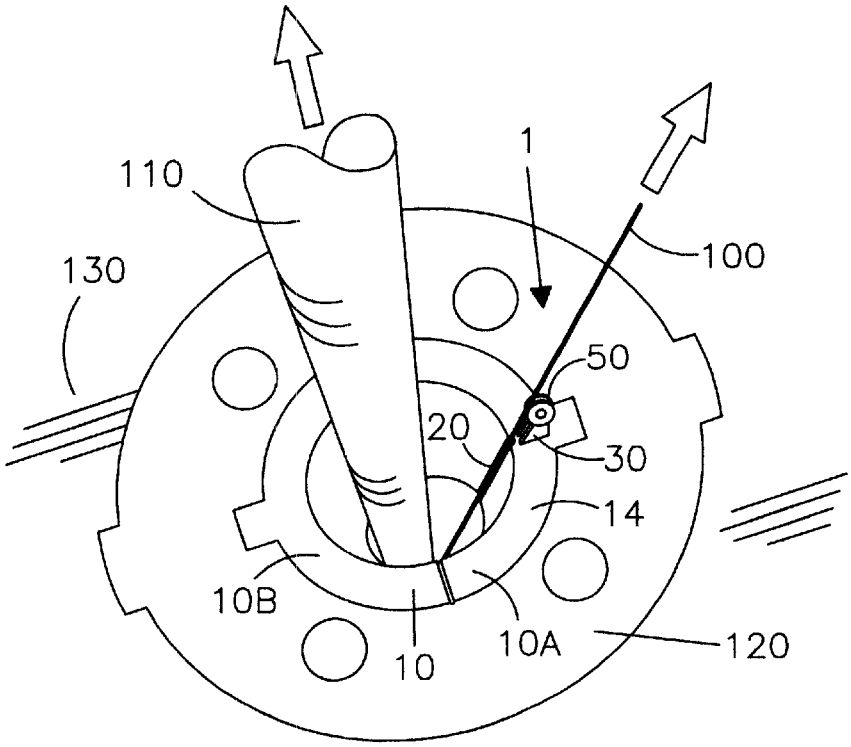
FIG. 1 is a perspective view of one embodiment of the invention illustrating the invention in relation to the components of a drilling rig platform, drill string, and wireline.

FIG. 1 shows the orientation of the wireline guiding apparatus of the invention 1 relative to the components of the drilling rig 130 and drill string 110. A rotary table 120 is shown positioned on a surface or deck of a drilling platform 130. An insert bowl 10, consisting of two halve pieces 10A, 10B, is inserted in the opening of the rotary table 120. A drill string 110and a wireline 100 are shown passing through the insert bowl 10. The apparatus for guiding wireline into a well bore 1 consists generally of an insert bowl 10A having a groove 20 formed in an interior surface 12 thereof. The groove 20 is sized to receive a wireline 100, and thereby protect the wireline 100 from abrasions and other damage. The groove 20 is preferably about 0.75 inches in width and about 0.6 inches in depth. The groove 20 preferably extends from the top 14 to the bottom of the insert bowl 10 in a generally vertical orientation.

Figure 2:
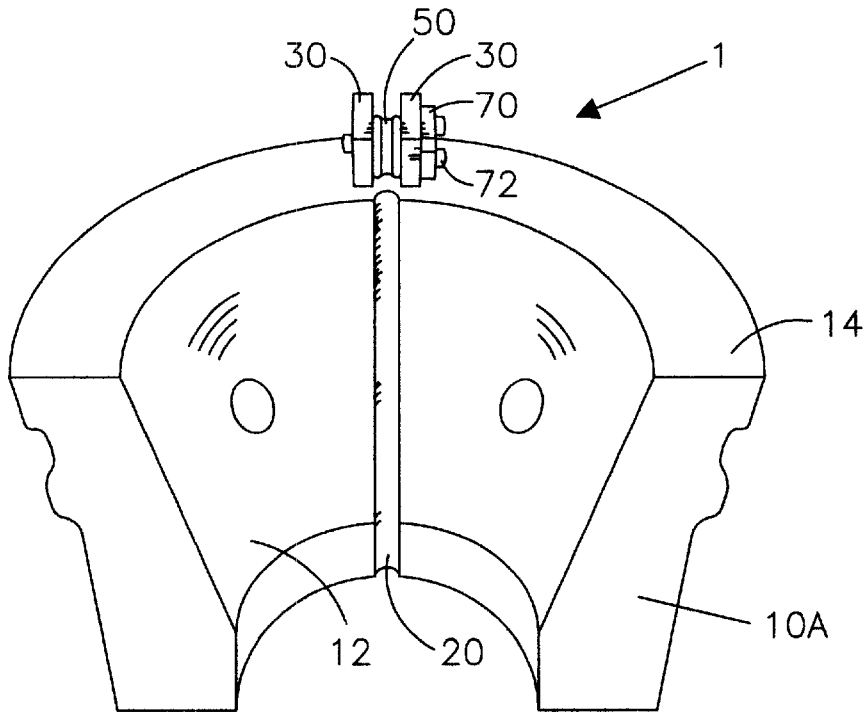
FIG. 2 is a front perspective view of one preferred embodiment of the invention.

As shown in the frontal view of FIG. 2, the groove 20 is substantially vertical when viewed from the front, the vertical path generally mirroring that of a wireline 100 passing through the insert bowl 10. As shown in FIG. 2, the interior surface 12 of the insert bowl 10A typically slopes outward toward the top 14 of the insert bowl 10A. When viewed from the side, the substantially vertical groove 20 is preferably provided with a degree of slope, the slope generally corresponding to the slope of the inner surface 12 of the insert bowl 10A.

Although the groove 20 is an improvement over the prior art, the invention 1 is preferably further provided with a rotation means 50 on the insert bowl 10. The rotation means 50 is configured and positioned to rotate against the wireline 100 and maintain the wireline 100 substantially in the groove 20 when the insert bowl 10A is positioned in the rotary table 120 of a drilling platform 130, thereby avoiding and preventing damage to the wireline 100 during wireline and drilling operations. Part of the weight of the wireline 100 is borne by the rotation means 50, so the means must be of substantial construction. In a preferred embodiment, part of the weight of the wireline 100 is also borne by at least a portion of the groove 20 of the insert bowl 10A, thereby reducing stress on the rotation means 50.

The rotation means 50 may also be used on an insert bowl 10A without a groove 20, but superior results are obtained when the rotation means 50 and the groove 20 are used in combination.

Figure 3:
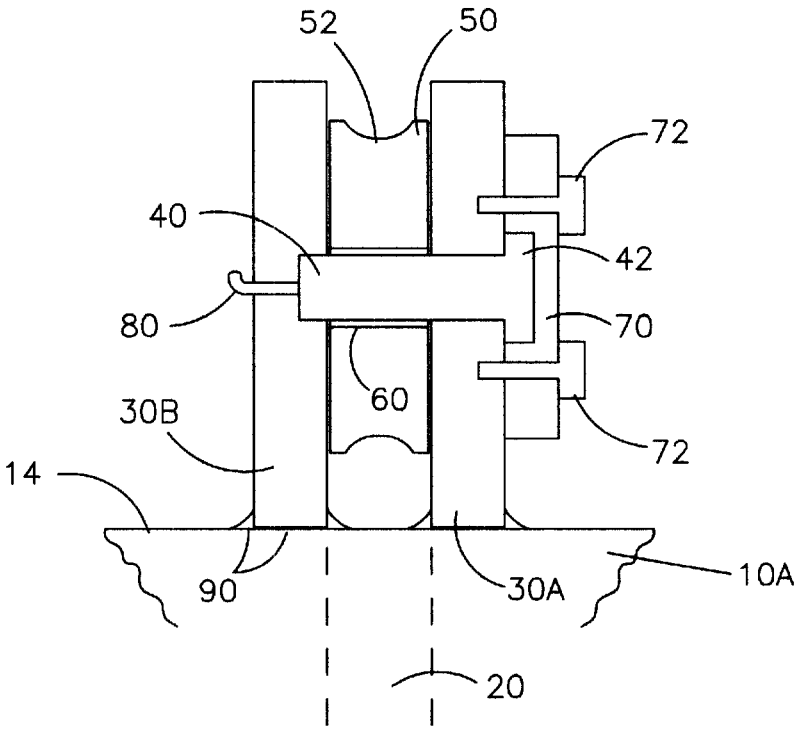
FIG. 3 is a cross-sectional front view of one preferred embodiment of the invention.
Figure 4:
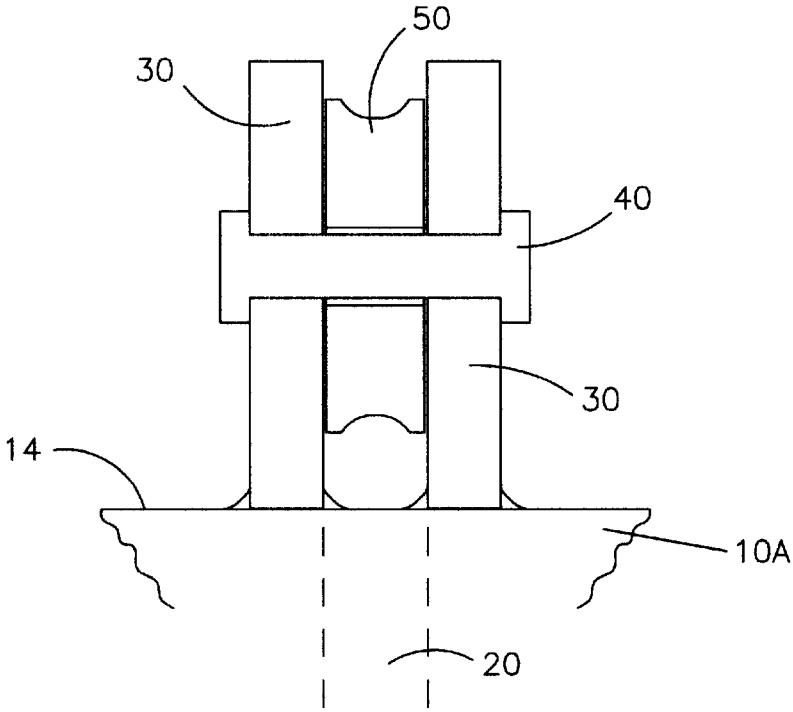
FIG. 4 is a cross-sectional front view of a second preferred embodiment of the invention.

As shown in FIG. 2, the rotation means 50 preferably comprises a support member 30 and a wheel 50 rotatably disposed in the support member 30. The support member 30 is preferably attached to a top 12 of the insert bowl 10A above the groove 20. The support member 30 is preferably welded to the insert bowl 10A, such as by welds 90. As shown in FIGS. 3 and 4, the wheel 50 is preferably configured as a sheave having a concave rim 52. The concave rim 52 is sized to engage a portion of the round surface of the wireline 100 and thereby assist in maintaining the orientation of the wireline 100 in the groove 20. The wheel 50 is positioned on the insert bowl 10A such that the rim 52 of the wheel extends at least partially into the path of the groove 20, such that the rim 52 engages the wireline 100 when disposed in the groove 20.

FIG. 4 shows a cross-section view of a preferred embodiment of a rotation means 50. In the embodiment shown in FIG. 4, the support member 30 comprises a first block member 30 positioned substantially along one side of the groove 20, a second block member 30 positioned substantially along an opposite side of the groove 20, and an axle shaft 40 passing between the first and second block members 30. The wheel 50 is rotatably disposed on the axle shaft 40.

FIG. 3 shows a preferred embodiment in which the components of the rotation means 50 may be readily disassembled after use. When disassembled, the various components of the rotation means can be inspected for wear, and can be cleaned, re-greased, or replaced if worn. In the apparatus shown in FIG. 3, the first block member 30A has a hole therethrough and the second block member 30B having a bore on an inner side thereof. The axle shaft 40 passes through the hole of the first block member 10A, and a first end of the axle shaft 40 is disposed in the bore of the second block member 30B. A second end of the axle shaft 40 may be provided with a head 42 for abutting against an outer side of the first support member 30A. A keeper means 70 is removably disposed on an outer side of the first block member 30A. The keeper means 70 retains the axle shaft 40 in the bore and the hole during wireline and drilling operations. The keeper means preferably comprises a keeper block 70 and at least a pair of bolts 72 removably securing the keeper block 70 to the outer side of the first block member 30A. As shown in FIG. 3, the apparatus is preferably provided with a race 60 disposed between the axle shaft 40 and the wheel 50. The apparatus is further preferably provided with a grease zert 80 passing through an outer side of the second block member 30B and communicating with the bore of the second block member 30B to thereby permit application of grease to the apparatus during drilling and wireline operations. All parts of the apparatus are preferably made of steel.

In the embodiment shown in FIG. 3, the shaft 40 remains stationary while the race 60 and wheel 50 rotate about the shaft 40. Alternatively, the shaft 40 can be configured to rotate along with the wheel 50.

In operation, the wireline guiding apparatus of the invention 1 is used in conventional wireline and drilling operations. The groove 20 can be formed using milling techniques well known to those of ordinary skill in the art. The rotation means 50 may be attached to the insert bowl 10A before or after the milling of the groove 20. In a preferred method, the rotation means 50 is attached to the insert bowl 10A prior to milling, so that the groove 20 can be milled with reference to the location of the rotation means 50. Attachment of the rotation means 50 is generally accomplished by welding the support member 30 to the insert bowl 10A, though other attachment means, such as bolts, can be used. If the preferred support member 30 shown in FIG. 3 is used, the first and second support members 30 are welded to the top 14 of the insert bowl 10A.

Once the apparatus of the invention 1 has been constructed according to the above steps, the insert bowl 10A is positioned in the rotary table 120 of the drilling platform 130 in the conventional manner. The groove 20 is positioned so as to follow the path of the wireline 100. With the wireline 100 positioned in the groove 20 of the insert bowl 10A, the wireline 100 is then tensioned against the rotation means 50 such that the wireline 100 rotates the rotation means 50 during lowering and raising of the wireline 100. Tensioning may occur automatically, depending on the location of the wireline feeding apparatus.

After wireline and drilling operations have been completed, the insert bowl 10A is preferably removed from the rotary table 120 and inspected for wear. If the preferred rotation means 50 shown in FIG. 3 has been used, the rotation means 50 can be dismantled by removing the keeper means 70 from the first block member 30A and then removing the axle shaft 40 and the wheel 50 from the support member. The components can then be inspected, cleaned, greased, and replaced as needed prior to using the apparatus in further wireline operations.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An apparatus for guiding wireline into a well bore comprising:

an insert bowl, said insert bowl having a substantially vertical groove formed in an interior surface thereof.

2. The apparatus of claim 1, further comprising a rotation means on said insert bowl, said rotation means configured and positioned to rotate against a wireline and maintain said wireline substantially in said groove when said insert bowl is positioned in a rotary table of a drilling platform, thereby avoiding and preventing damage to said wireline during wireline and drilling operations.

3. The apparatus of claim 2, wherein said rotation means comprises a support member and a wheel rotatably disposed in said support member, said support member attached to a top of said insert bowl above said groove.

4. The apparatus of claim 3, wherein said support member further comprises a first block member positioned substantially along one side of said groove, a second block member positioned substantially along an opposite side of said groove, and an axle shaft passing between said first and second block members, said wheel being rotatably disposed on said axle shaft.

5. The apparatus of claim 4, further comprising a race disposed between said axle shaft and said wheel.

6. The apparatus of claim 4, further comprising said first block member having a hole therethrough, said second block member having a bore on an inner side thereof, said axle shaft passing through said hole of said first block member, a first end of said axle shaft disposed in said bore of said second block member, and a keeper means removably disposed on an outer side of said first block member, said keeper means retaining said axle shaft in said bore and said hole during wireline and drilling operations.

7. The apparatus of claim 6, wherein said keeper means comprises a keeper block and at least a pair of bolts removably securing said keeper block to said outer side of said first block member.

8. The apparatus of claim 6, further comprising a grease zert passing through an outer side of said second block member and communicating with said bore to thereby permit application of grease to said apparatus during wireline and drilling operations.

9. The apparatus of claim 3, wherein said wheel is configured as a sheave having a concave rim.

10. The apparatus of claim 2, wherein said groove extends substantially from an upper end to a lower end of said insert bowl.

11. A method of guiding a wireline into a well bore comprising:

(a) providing an insert bowl;

(b) attaching a rotation means to said insert bowl;

(c) forming a substantially vertical groove in said insert bowl below said rotation means;

(d) positioning said insert bowl in a rotary table of a drilling platform;

(e) lowering a wireline through said insert bowl;

(f) positioning said wireline in said groove of said insert bowl;

(g) tensioning said wireline against said rotation means such that said wireline rotates said rotation means during lowering and raising of said wireline.

12. The method of claim 11, wherein said step of attaching a rotation means to said insert bowl is carried out before said step of forming a groove.

13. The method of claim 11, wherein said rotation means comprises a support member and a wheel rotatably disposed in said support member.

14. The method of claim 13, wherein said support member further comprises a first block member positioned substantially along one side of said groove, said first block member having a hole therethrough, a second block member positioned substantially along an opposite side of said groove, said second block member having a bore on an inner side thereof opposite said hole of said first block member, an axle shaft passing through said hole of said first block member, a first end of said axle shaft disposed in said bore of said second block member, and a keeper means removably disposed on an outer side of said first block member, said keeper means retaining said axle shaft in said bore and said hole during wireline and drilling operations, said wheel being rotatably disposed on said axle shaft.

15. The method of claim 14, further comprising the step of, when wireline operations have been completed and said wireline has been removed from said insert bowl, removing said keeper means from said first block member and further removing said axle shaft and said wheel from said support member for inspection and maintenance.

* * * * *